United States Patent [19]

Marschke

[11] 4,219,378

[45] Aug. 26, 1980

[54] WEB SPLICING

[75] Inventor: Carl R. Marschke, Phillips, Wis.

[73] Assignee: Marquip, Inc., Phillips, Wis.

[21] Appl. No.: 30,475

[22] Filed: Apr. 16, 1979

Related U.S. Application Data

[60] Division of Ser. No. 793,552, May 4, 1977, Pat. No. 4,170,506, which is a continuation of Ser. No. 669,309, Mar. 22, 1976, abandoned.

[51] Int. Cl.[2] ..... B65H 19/16; B65H 19/18; B65H 19/20

[52] U.S. Cl. ..... 156/502; 156/157; 156/159; 156/504; 156/505; 242/58.1; 242/58.3; 242/58.5

[58] Field of Search ..... 156/157, 159, 502, 504, 156/505, 506, 507, 508, 509; 242/58.1, 58.3, 58.5

[56] References Cited

U.S. PATENT DOCUMENTS

| | | | |
|---|---|---|---|
| 3,749,634 | 7/1973 | Krause | 156/157 |
| 3,837,954 | 9/1974 | Nudinger | 156/159 |
| 3,841,944 | 10/1974 | Harris | 156/159 |
| 3,858,819 | 1/1975 | Butler | 242/58.3 |
| 3,918,655 | 11/1975 | Hillner et al. | 156/504 |
| 3,939,032 | 2/1976 | Taitel et al. | 156/159 |
| 3,956,047 | 5/1976 | Johnson | 156/159 |

*Primary Examiner*—Caleb Weston

*Attorney, Agent, or Firm*—Andrus, Sceales, Starke & Sawall

[57] ABSTRACT

A splicer for use with machines which receive and handle a web of paper or other suitable material supplied in a continuous length. The paper is supplied from a pair of rolls and when one roll is exhausted, the other one is substituted. A movable splicer assembly is disposed adjacent a paper supply roll and which includes an idler roll, a paper stop device, a severing device and a splice sealing roll. When the assembly is disposed adjacent the nearly exhausted paper roll, the stop device is actuated to hold the outgoing web from moving, regardless of the existence or adequacy of a roll brake. When the assembly is disposed adjacent the spent roll, the stop device positively holds the paper for lead-edge cutting and trimming during set-up and to keep the paper in place until the splice is made. The splice sealing roll has provisions to guide a cutting tool for said lead-edge forming of the fresh web, and also for optimally locating the lead edge. An idler roll is disposed at the discharge end of the splicing area, with the idler roll cooperating with a tensioned dancer or accumulator roll to maintain proper tension on the paper web at all times. The idler roll is convertible to a capstan drive roll when the splice has been made to thereby increase the paper tension upstream and assist in acceleration of the web from the fresh roll up to normal speed.

4 Claims, 9 Drawing Figures

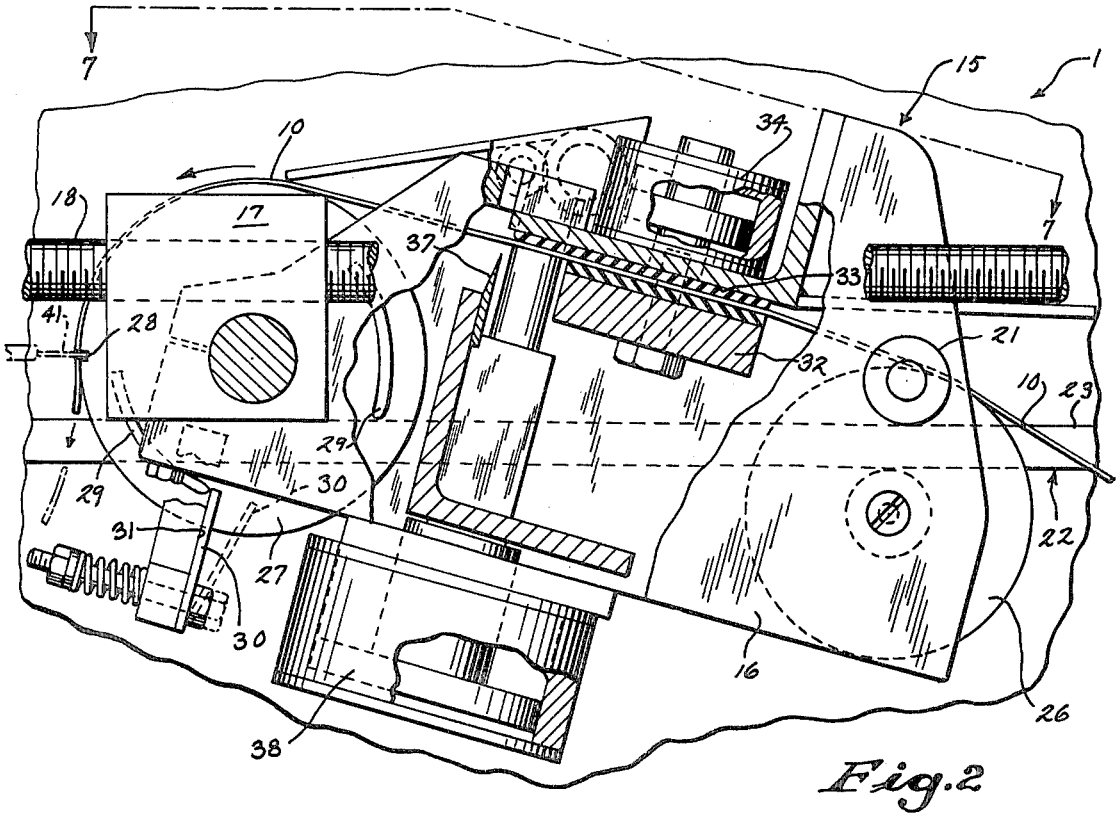
Fig.2
Fig.3
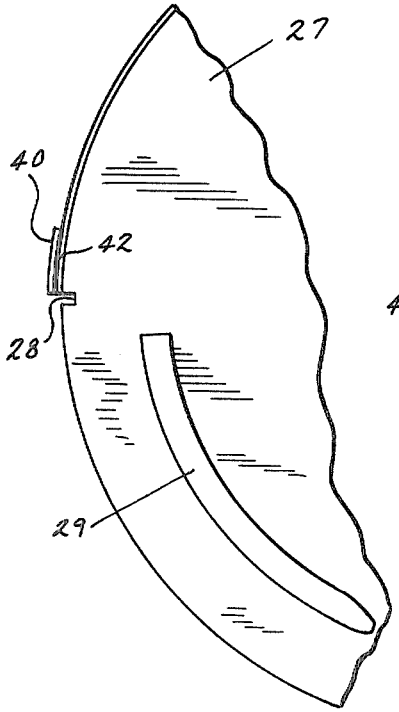
Fig.4
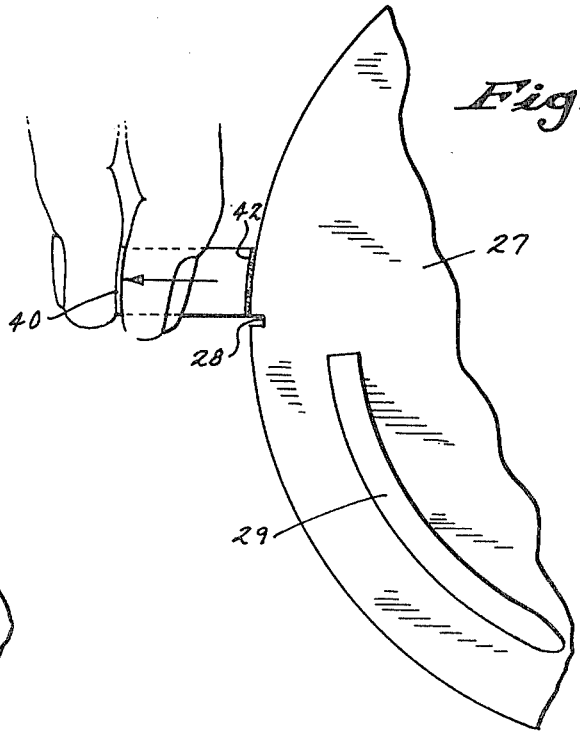

1
9
10
14
15
16
16a
17
17a
18
18a
21
21a
22
23
23a
24
24a
25
25a
26
26a
27
27a
28
28a
29
29a
30
30a
31
31a
32
32a
33
33a
34
34a
36
37
37a
38
38a
42
43

WEB SPLICING

This is a division of application Ser. No. 793,552, filed May 4, 1977, U.S. Pat. No. 4,170,506, which in turn is a continuation of application Ser. No. 669,309, filed Mar. 22, 1976, and now abandoned.

BACKGROUND AND SUMMARY OF THE INVENTION

This invention relates to web splicing for paper and the like, and more particularly to a concept involving splicing together the web from a fresh roll of paper and the web from a nearly spent roll of paper in a continuous paper web feeding operation.

The concepts of the invention can be utilized in connection with a large variety of devices where a web of paper or other material is continuously supplied. One such device can be a machine for wrapping boards with paper, such as in the present inventor's U.S. Pat. No. 3,590,552 issued July 6, 1971 and entitled "Automatic Panel Wrapping Machine." Another such device can be a corrugating machine.

In such machines, the paper supply comprises a pair of paper rolls which alternately feed a web of paper in continuous fashion to the machine input. When one roll is exhausted, the other roll is substituted. To prevent extensive down time, it has been found desirable to quickly splice the web of a fresh roll onto the web of a nearly exhausted roll.

The machine of aforementioned U.S. Pat. No. 3,590,552 includes such a device. In that patent, the task of splicing two supply webs together was accomplished by forcing an eccentric roll against an idler roll, with the paper traveling between the rolls, and with the movement of the eccentric roll automatically causing a knife to sever the web of the nearly exhausted roll.

In other known devices, a paper roll brake has been used to bring the exhausted paper roll to a stop for web splicing. In addition, the splicing has been accomplished by pressing the two webs together between a pair of splice sealing rolls which form a nip, and by the use of an adhesive between the webs. It is further known to feed the running or spliced web continuously over an idler roll disposed downstream from the splicing apparatus, and then to an accumulator or dancer roll, and subsequently to the machine which is to utilize the paper web. See U.S. Pat. No. 3,841,944 to Harris, Jr. In addition, it has been proposed to apply an adjesive strip to a new web attached to a splice sealing roll and then to rotate this roll to bring the adhesive into position for a horizontal engagement with the expiring roll. See U.S. Pat. No. 3,837,954 to Nudinger et al.

Heretofore, it has been found difficult to get the spliced web, which has momentarily been stopped, up to normal speed as quickly as possible before the excess web at the accumulator dancer roll runs out. Furthermore, it has been found that with at least some of the known structures, misalignment between the paper webs which may occur between the paper supply rolls and the splicing rolls may continue on downstream up to and past the idler roll, thereby causing tensions to develop which will rip or tear the paper web.

It is the task of the present invention to significantly reduce one or both of the above problems, and also to splice two webs together in an entirely new way so that the same splicer can be added to many types of web handling machines without major modification of the latter. Progress in the technical art of web splicing has therefor been accomplished.

In the form of the device shown, at least one movable splicer assembly is disposed adjacent a paper supply roll and which includes an idler roll, a paper stop device, a severing device and a splice sealing roll. When the assembly is disposed adjacent the nearly exhausted paper roll, the stop device is actuated to hold the outgoing web from moving, regardless of the existence or adequacy of a roll brake. When the assembly is disposed adjacent the spent roll, the stop device positively holds the paper for lead-edge cutting and trimming during set-up and keeps the paper in place until the splice is made. The splice sealing roll has provisions to guide a cutting tool for said lead-edge forming of the fresh web, and also for optimally locating the lead edge. A separate splicer assembly is disposed adjacent each of the pair of rolls, with the splice sealing rolls being engageable to form a nip for sealing the splice.

In accordance with one aspect of the invention, the fixed idler roll which is disposed at the discharge end of the splicing area and upstream of the accumulator dancer roll, is provided with a drive mechanism which includes a motor and which may include a selectively engageable clutch therebetween. At the time of the splice, the motor is driven to convert the idler roll into a driven capstan which accelerates the spliced web up to line speed; and thereafter the drive is disengaged. This substantially reduces the problem of exhaustion of the accumulator before the new web can be supplied.

In accordance with another aspect of the invention, driving of the idler roll after splicing will cause the capstan effect to pull the web forwardly, thus reducing problems caused by misalignment.

BRIEF DESCRIPTION OF THE DRAWINGS

The accompanying drawings illustrate the best mode presently contemplated by the inventor for carrying out the invention.

In the drawings:

FIG. 2 is an enlarged fragmentary side view of a splicer assembly in the position shown in phantom in FIG. 1 with parts broken away and in section;

FIG. 3 is an enlarged fragmentary side view of a splice sealer roll and showing adhesive transfer tape applied adjacent the cut-off slot;

FIG. 4 is a view similar to FIG. 3 and showing the tape being removed;

DESCRIPTION OF THE PREFERRED EMBODIMENT

Figure 1:
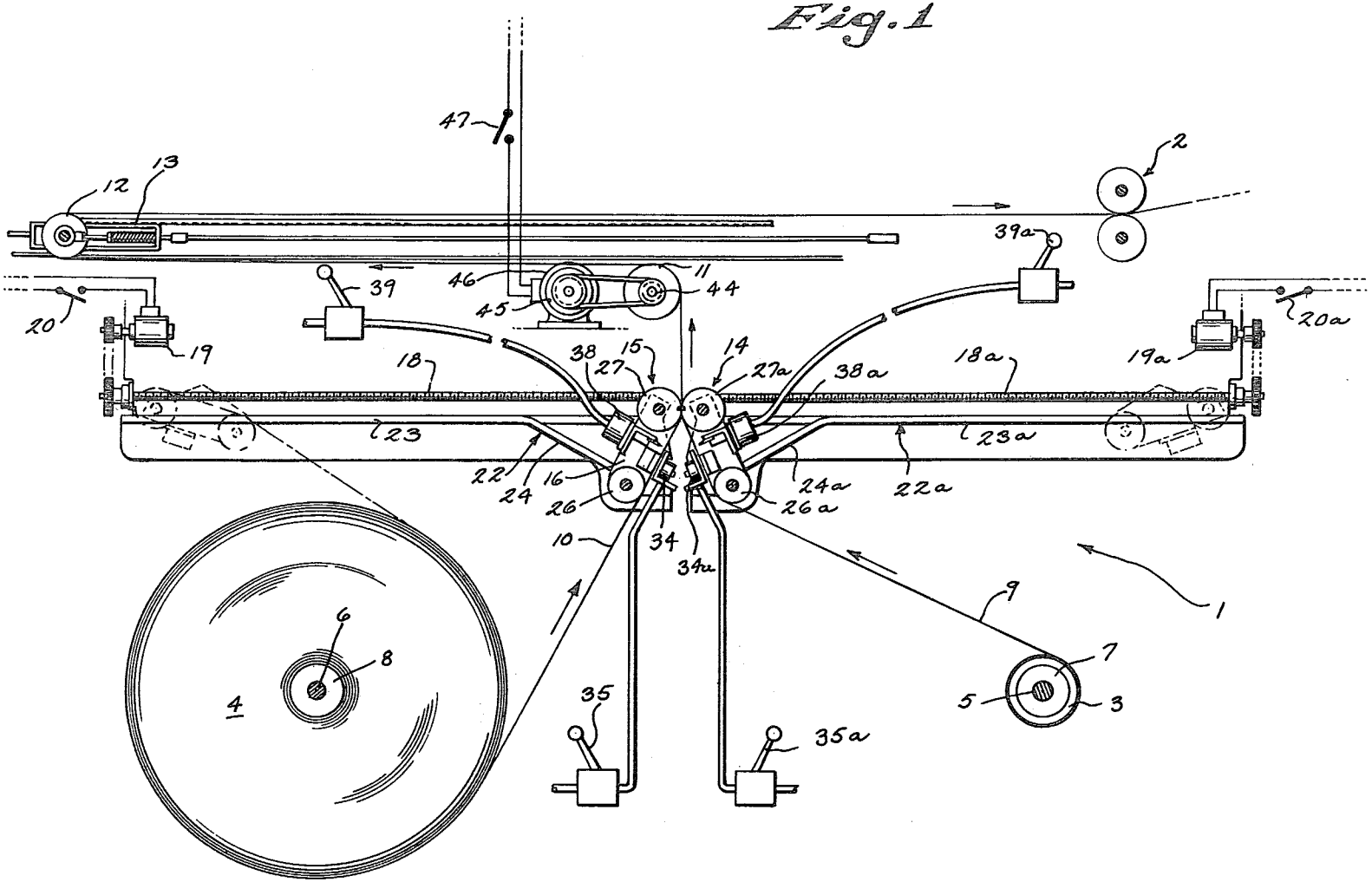
FIG. 1 is a schematic side elevation of an apparatus constructed in accordance with the invention and showing two positions of each splicer assembly.

As shown in the drawings, the splicer of the present invention is adapted for use with an unwind station 1 of any suitable type of web handling machine, not shown except for an input nip 2. Station 1 comprises a pair of paper rolls 3 and 4 rotatably mounted on parallel shafts 5 and 6 respectively, with brakes 7 and 8 engageable with the respective shafts to control the paper rolls.

Paper rolls 3 and 4 are shown as having respective webs 9 and 10 extending therefrom.

In the present instance, roll 3 is shown as having its web 9 extending through the apparatus to machine input nip 2. This apparatus includes a fixed idler roll 11 on the downstream side of the apparatus and over which the web 9 extends, and a dancer roll 12 of any suitable desired well-known type which is mounted for movement in a horizontal channel 13. Dancer roll 12 is maintained under tension to thereby keep web 9 tensioned.

In the drawings, paper roll 3 is shown as being nearly exhausted and it is desired to substitute fresh roll web 10 for web 9 in a manner to provide an unbroken web feed to nip 2. This is accomplished by splicing the webs together and severing web 9 behind the splice.

For this purpose, and in the embodiment shown in the drawings, splicer assemblies 14 and 15 are provided for each respective paper roll 3, 4. Assembly 15 comprises a carriage 16 having a pair of blocks 17 mounted for movement along a pair of threaded shafts 18, which in turn are rotatably driven in synchronism by a reversible motor 19 actuated by a switch 20. Carriage 16 carries roller followers 21 adapted to follow fixed cam tracks 22 having horizontal outer portions 23 which merge into inclined portions 24 having vertical inner end portions 25. Only one block 17, shaft 18 and cam arrangement for assembly 15 are shown. Carriage 16 carries a pair of spaced rolls, with roll 26 comprising an idler roll and roll 27 comprising a splice sealer roll normally positioned on the far side of roll 26 remote from paper roll 3. Splice sealer roll 27 is provided with a longitudinal slot 28 on its surface, and there is provided a unidirectional detent mechanism comprising arcuate projections 29 on the roll and a spring biased pivotal arm 30 and stop 31 for purposes to be described. See FIGS. 2 and 5.

A paper stop means is provided between rolls 26 and 27 and adjacent idler roll 26. For this purpose, and in the embodiment shown in FIGS. 2, 5 and 6, an elongated stop bar 32 is mounted to carriage 16 parallel to roll 26, with bar 32 being movable into and out of engagement with a parallel support 33 by means of a control cylinder 34 connected to a suitable source of pressurized fluid and actuatable by a lever 35. Under normal conditions, stop bar 32 and support 33 are separated by a space 36.

In addition, a paper severing means is provided between the paper stop means and splice sealer roll 27. For this purpose, and in the present embodiment, a longitudinal elongated web cut-off knife 37 is mounted to carriage 16 parallel to roll 27, with knife 37 being movable transversely by means of a control cylinder 38 connected to a suitable source of pressurized fluid and actuatable by a lever 39.

Splicer assembly 14 is substantially identical to assembly 15 and like numbers with an "a" suffix have been applied to the respective parts 16–39 and others in the drawings. As can be seen, assembly 14 and its associated parts are mounted in reversed opposed relationship to assembly 15.

During normal operation of the web handling machine, both assemblies are positioned in spaced apart relationship on shafts 18, 18*a*, with the assembly for the web of the running roll in position as shown in full lines in FIG. 1, and the other assembly moved back along its shafts such as at the end position as shown in phantom in FIG. 1, and tilted from its working position.

As heretofore explained, it is desired to splice fresh web 10 to web 9, and the procedure will now be described.

Figure 5:
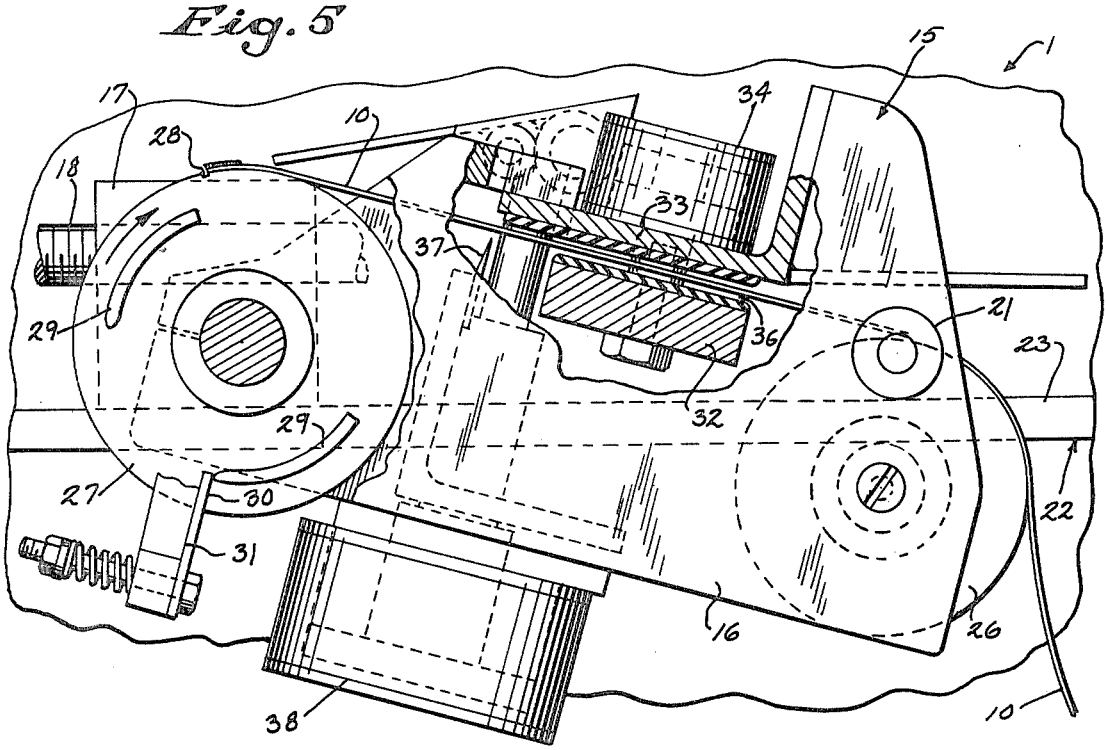
FIG. 5 is a view similar to FIG. 2 and showing the paper web released and the splice sealer roll rotated back to the detent.
Figure 7:
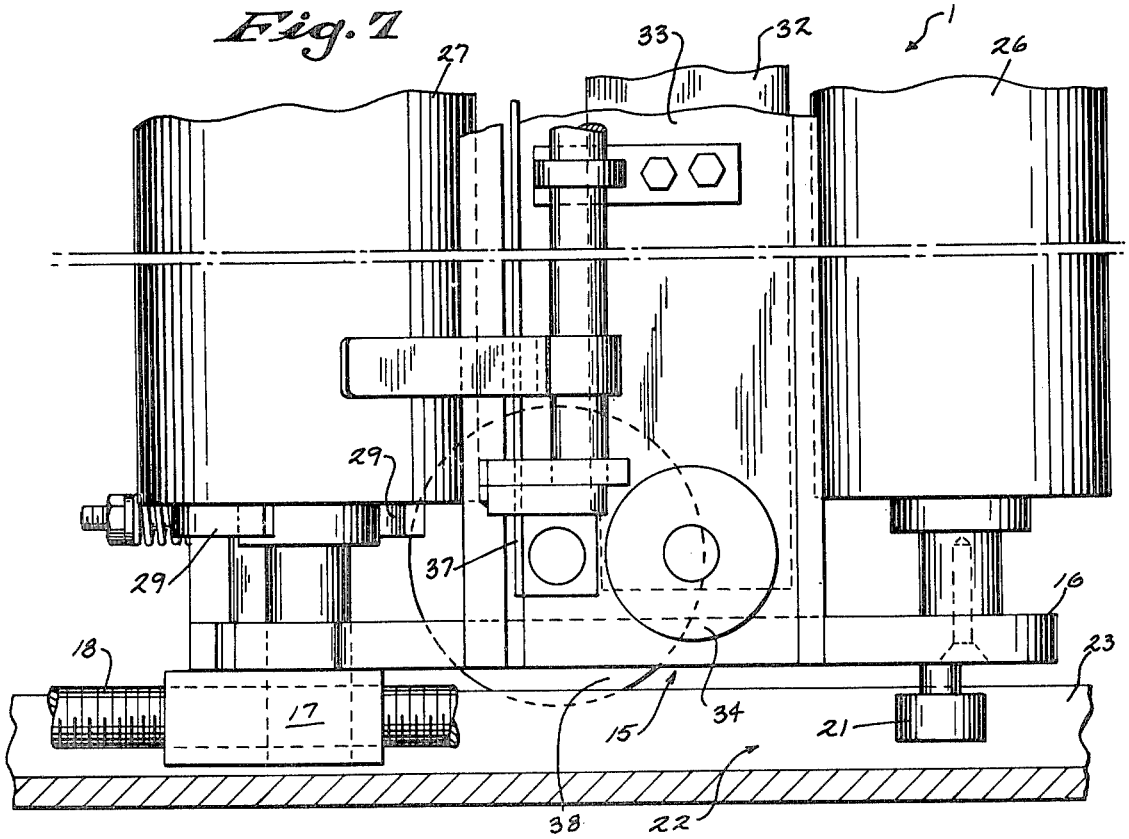
FIG. 7 is a top plan view taken on line 7—7 of FIG. 2.
Figure 6:
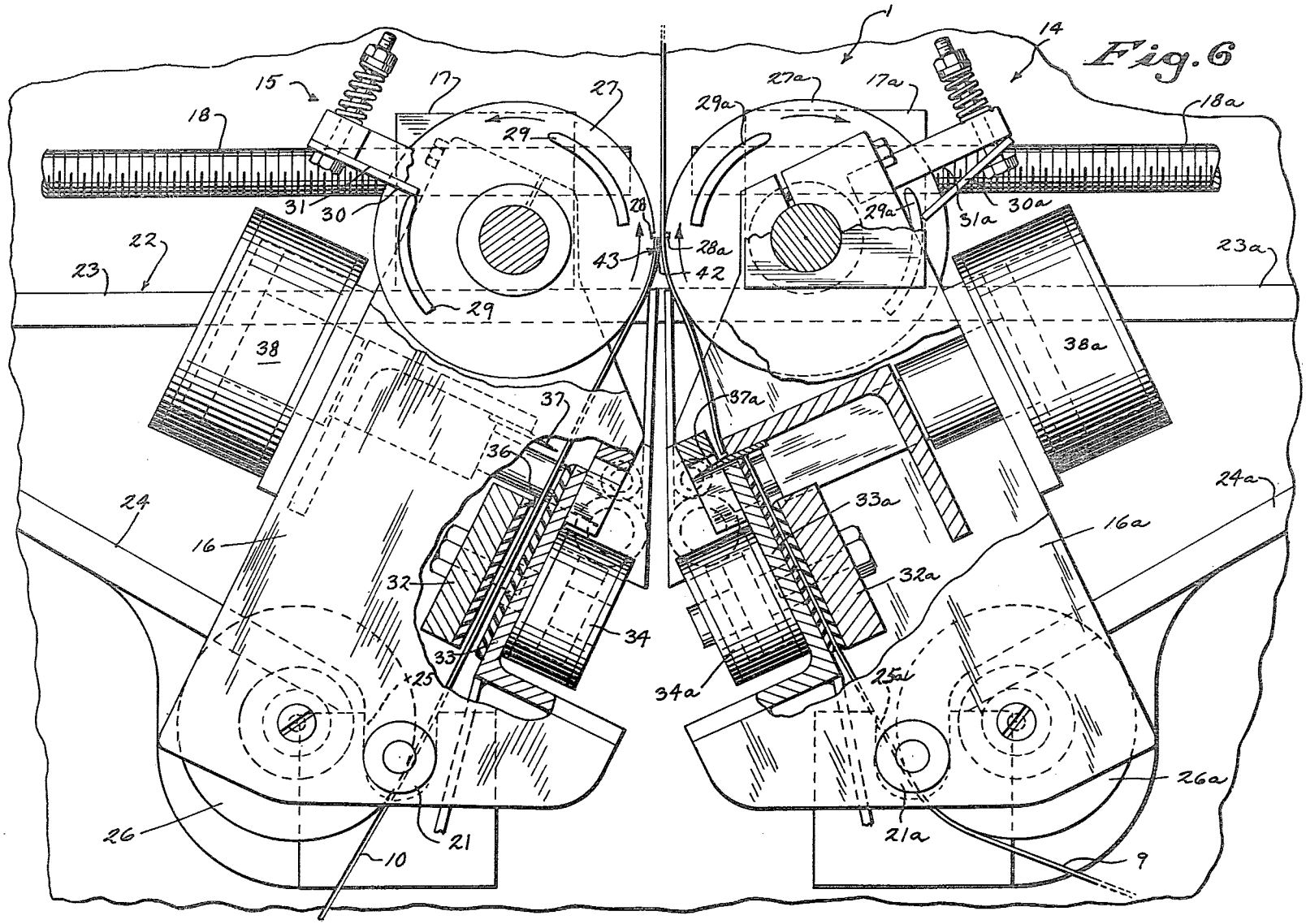
FIG. 6 is an enlarged fragmentary view showing the splice sealer rolls in pressure contact for splicing and showing the spent paper web cut-off.

As shown in FIGS. 2–4, web 10 is manually pulled from fresh roll 4, extended over idler roll 26 of assembly 15 and threaded through space 36 and past knife 37 and around over splice sealing roll 27. When sufficient paper has been pulled through so that no wrinkles exist, lever 35 is actuated to cause stop bar 32 to clamp the paper to support 33 as shown in FIG. 2, thus preventing web movement in any direction. Adhesive is then applied to the forward edge portion, as by use of well-known transfer tape 40. The operator then inserts a sharp instrument 41 in slot 28 in roll 27 and by drawing it through the slot cuts the leading edge of the web so that it is square. Other methods of web cutting and alignment may be utilized. FIG. 3 shows tape 40 after application to the web edge, and FIG. 4 shows the tape backing being removed after web cut-off, leaving the adhesive layer 42 exposed. Stop bar 32 may then be released as shown in FIG. 5, and with the web being manually held to the splice sealer roll 27, the latter is manually reversably indexed until detent projection 29 engages arm 30 to stop roll 27. The leading web edge will then be accurately and automatically positioned for splicing after the assembly has been shifted. Stop bar 32 is then re-engaged. Switch 20 is then actuated to cause motor 19 to move the entire assembly 15 to above paper roll 4 and into the ready-to-splice position. Movement of blocks 17 along shafts 18 and of followers 21 along cam tracks 22 will cause assembly 15 to pivot to the position shown in full lines in FIG. 1. The configuration of cam tracks 22 is such that assembly 15 will maintain its generally horizontal position until after it has cleared the top of roll 4, at which time it quickly pivots to its more vertical position. With assembly 14 already being in the splice position with web 9 extending therearound, assembly 15 is brought up to the ready-to-splice position so that its splice sealer roll 27 is spaced slightly from splice sealer roll 27*a* of assembly 14 with assemblies 14 and 15 diverging downwardly. Adhesive layer 42 is now on the side of roll 27 facing roll 27*a*.

The splice is now ready to be made.

Brake 7 is actuated to "full on" condition to bring spent roll 3 to a stop as quickly as possible. At the same time, independently and regardless of the adequacy of brake 7, lever 35*a* is moved to clamp stop bar 32*a* to support 33*a* to stop movement of web 9 at the splicer assembly 14. Carriage 16 for the new paper roll splicer assembly 15 is then actuated by switch 20, motor 19 and shafts 18 to bring splice sealer roll 27 up tightly against splice sealer roll 27*a* to create a high pressure splicing nip 43. See FIG. 6. The lead edge of web 10 with adhesive 42 thereon will be pressed against web 9 and confined between rolls 27 and 27*a*, to form the splice.

Lever 39*a* is moved to activate knife 37*a* to sever web 9 from spent paper roll 3 and upstream of nip 43. See FIG. 6.

At about the same time, lever 35 is moved to release stop bar 32 from fresh web 10.

Splicer carriage 16*a*, which is on the spent paper roll side- is backed off to permit free run of the new web 10.

At the time of the splice between webs 9 and 10, idler roll 11, which is upstream from accumulator dancer roll 12, is ready to commence its inventive function.

As shown in FIG. 1, and in accordance with one aspect of the invention, idler roll 11 is provided with a fixed shaft 44 which in turn is connected by a belt through a clutch 45 to a drive motor 46. When a switch 47 is actuated, clutch 45 will be engaged and driven by motor 46 to convert roll 11 to a capstan which accelerates the spliced web back to line speed after splicing, old web severing and brake release has occurred. This reduces the problem of run-out of the accumulator dancer roll 12. As soon as the spliced web has reached the normal line speed, switch 47 is actuated to stop the action of clutch 45, and roll 11 returns to its usual idling function.

In accordance with another aspect of the invention, the capstan action of the clutched roll 11 causes a substantial re-alignment of any misaligned web at or upstream of the splicing device and prior to the web reaching the accumulator dancer roll 12. Tearing and ripping of the web is substantially reduced.

Spent paper roll 3 may then be replaced with a fresh paper roll and, when paper roll 4 nears exhaustion, the above described procedure is again followed, but with opposite splicer assemblies perfomring opposite functions.

Numerous variations of the splicing concept disclosed herein may be made without departing from the spirit of the invention.

Figure 8:
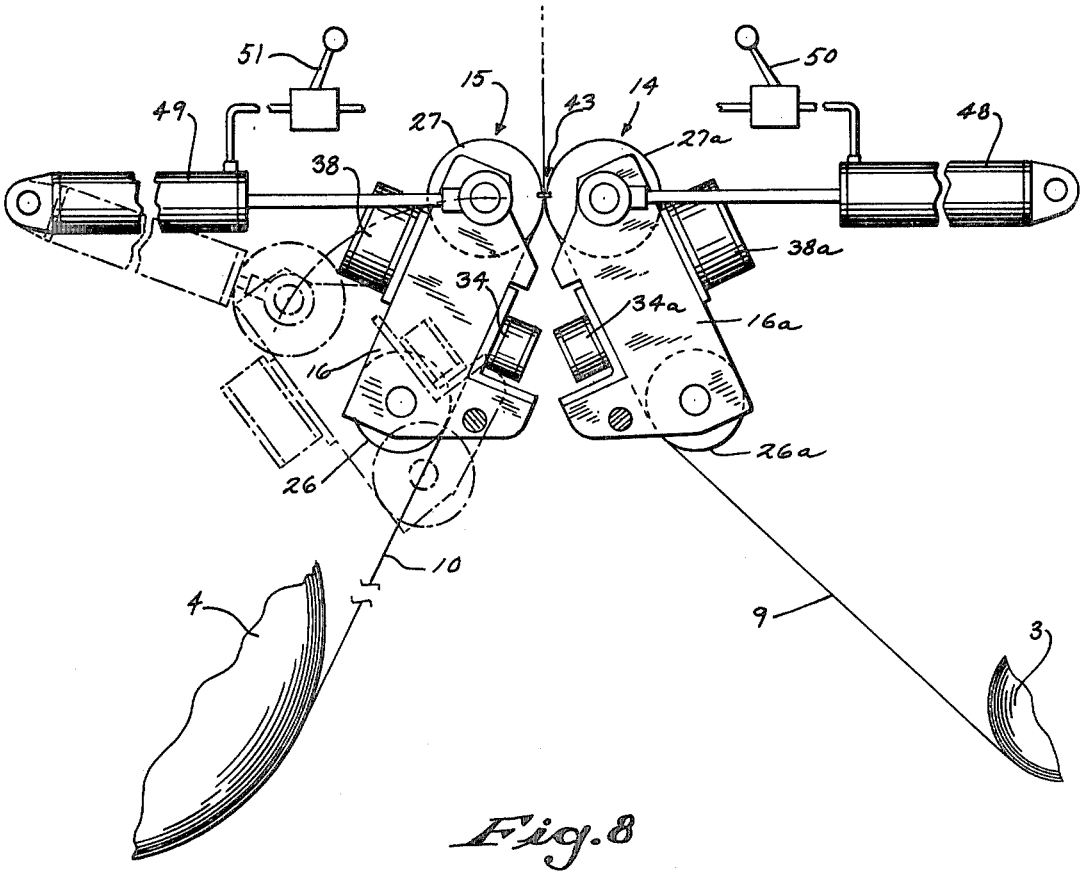
FIG. 8 is a schematic side view of another embodiment.

For example, and as shown in FIG. 8, splicer assemblies 14 and 15 could be disposed permanently above rolls 3 and 4, and pivoted as by opposing cylinders 48 and 49 actuated by respective levers 50 and 51, to selectively bring splicer sealer rolls 27 and **27*a* into pressure engagement to form the splicing nip 43**.

Figure 9:
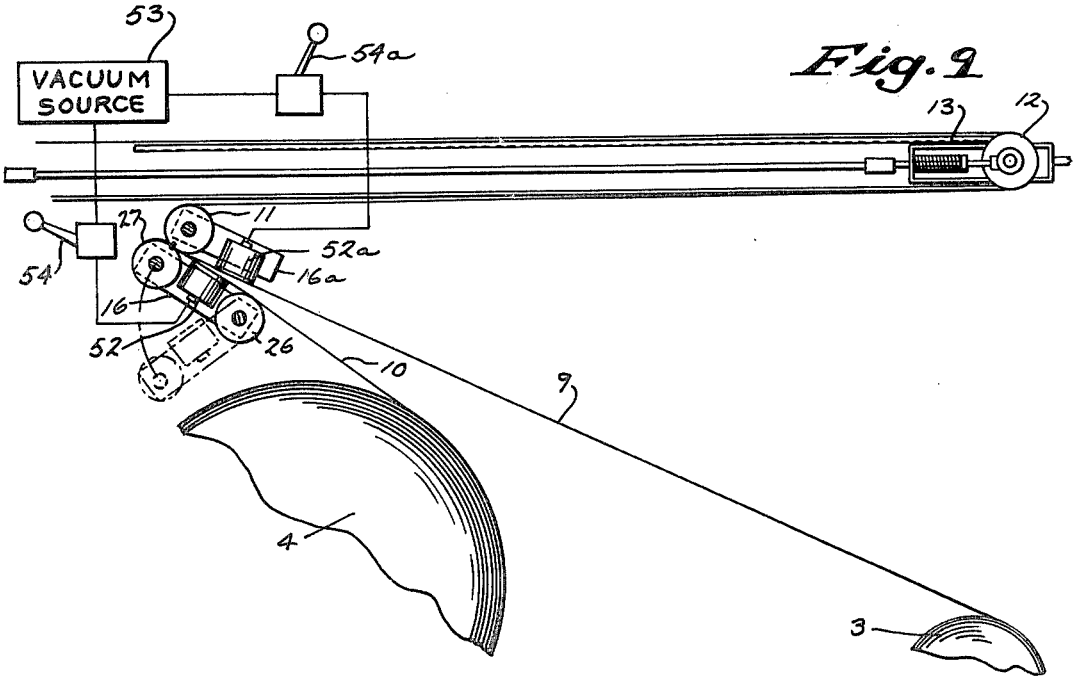
FIG. 9 is a schematic side view of yet another embodiment.

In addition, under some conditions and as shown in FIG. 9, the paper stop means may comprise vacuum heads 52, **52*a* over which the web passes and which are connected to a source of vacuum 53 and are actuated by valve levers 54, 54*a*. Furthermore, and as shown in the same figure of the drawings, the splicing apparatus may be positioned relative to dancer roll 12 so that idler-capstan roll 11 also functions as a splice sealer roll with clutched motor drive, not shown. As shown, idler-capstan roll 11 has replaced splice sealer roll 27*a* and splicer assembly 14 is fixed, with only splicer assembly 15 being pivotal into engagement with assembly 14 in any suitable manner. Also, in this instance, idler roll 26*a*** may be dispensed with.

While various elements of the device have been disclosed as manually actuated, the elements would preferably be actuated by a suitable automatic control mechanism for high speed operation without departing from the spirit of the invention.

Various modes of carrying out the invention are contemplated as being within the scope of the following claims particularly pointing out and distinctly claiming the subject matter which is regarded as the invention.

I claim:

1. For use in connection with a machine for utilizing a traveling continuous web of paper or the like, and wherein a plurality of paper supply rolls are provided so that when the web of one paper roll is nearly exhausted, the web of a fresh paper roll can be substituted therefor, apparatus comprising:

(a) a splicing device disposed downstream from said supply rolls, (b) a dancer roll disposed between said splicing device and the input to the said machine, (c) a fixed idler roll disposed between said splicing device and said dancer roll, (d) means for causing a first-named web to feed from one of the said paper rolls past said splicing device and over said fixed idler roll and hence past said dancer roll and to the said input of the machine, (e) means for applying a braking force to said first-named web downstream of said one of said paper rolls and upstream of said splicing device, (f) means at said splicing device for splicing a second-named web to the said first-named web, (g) means for severing the second-named web from the first-named web, (h) means for releasing said braking force, (i) and means for then driving said idler roll as a capstan to tension and accelerate the spliced web back to line speed.

2. The apparatus of claim 1 which includes means for releasing the drive of said idler roll after line speed of the web has been reached.

3. The apparatus of claim 1 wherein the means for driving said idler roll as a capstan also forms means to reduce misalignment of said spliced web upstream from said capstan.

4. For use in connection with a machine for utilizing a traveling continuous web of paper or the like, and wherein a plurality of paper supply rolls are provided so that when the web of one paper roll is nearly exhausted, the web of a fresh paper roll can be substituted therefor, apparatus comprising:

(a) a splicing device disposed downstream of said supply rolls and with said splicing device having a pair of splice sealing rolls forming a nip, (b) a dancer roll disposed between said splicing device and the input to the machine, (c) a fixed idler roll disposed between said nip and said dancer roll, (d) means for causing a first-named web to feed from one of the said paper rolls past said splicing device over said fixed idler roll and hence past said dancer roll and to the said input of the machine, (e) means for applying a braking force to said first-named web downstream of said one of said paper rolls and upstream of said splicing device, (f) said splicing device including means for splicing a second-named web to the said first-named web at said nip, (g) means for severing the second-named web from the first-named web, (h) means for releasing said braking force, (i) and means for then driving said idler roll as a capstan to tension and accelerate the spliced web back to line speed.

* * * * *